US009214100B2

(12) United States Patent
Poelker

(10) Patent No.: US 9,214,100 B2
(45) Date of Patent: Dec. 15, 2015

(54) IDENTIFICATION MAT FOR IDENTIFYING ELECTRICAL COMPONENTS, AND METHOD FOR MANUFACTURING SUCH AN IDENTIFICATION MAT

(75) Inventor: Thomas Poelker, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 16 days.

(21) Appl. No.: 13/817,548

(22) PCT Filed: Aug. 16, 2011

(86) PCT No.: PCT/EP2011/004124

§ 371 (c)(1),
(2), (4) Date: Feb. 19, 2013

(87) PCT Pub. No.: WO2012/022469

PCT Pub. Date: Feb. 23, 2012

(65) Prior Publication Data

US 2013/0152440 A1 Jun. 20, 2013

(30) Foreign Application Priority Data

Aug. 20, 2010 (DE) ..... 10 2010 034 993

(51) Int. Cl.

| | |
|---|---|
| ***A47G 29/10*** | (2006.01) |
| ***A47G 7/00*** | (2006.01) |
| ***G09F 3/00*** | (2006.01) |
| ***B41J 3/407*** | (2006.01) |

(Continued)

(52) U.S. Cl.

CPC ..... *G09F 3/0286* (2013.01); *B41J 3/407* (2013.01); *G09F 3/02* (2013.01); *G09F 3/06* (2013.01); *G09F 2003/0201* (2013.01); *G09F 2003/0226* (2013.01)

(58) Field of Classification Search

CPC ..... G09F 3/0286; G09F 3/202; G09F 3/205; H01B 7/368; B29C 45/0025; B29C 45/141819; B29C 39/10

USPC ..... 40/316; 264/279

See application file for complete search history.

(56) References Cited

U.S. PATENT DOCUMENTS

| | | | | |
|---|---|---|---|---|
| 3,519,463 | A * | 7/1970 | Baum | 428/477.7 |
| 4,417,410 | A * | 11/1983 | Freedom | 40/330 |
| 5,059,373 | A * | 10/1991 | Hirabayashi | 264/154 |

(Continued)

FOREIGN PATENT DOCUMENTS

| | | |
|---|---|---|
| DE | 8 404 741 U1 | 9/1985 |
| DE | 202004009980 U1 | 11/2005 |

(Continued)

*Primary Examiner* — Joanne Silbermann

(74) *Attorney, Agent, or Firm* — Leydig, Voit & Mayer, Ltd.

(57) ABSTRACT

An identification mat for identifying electrical components having a plurality of identification units, wherein an identification unit has a crossbar and a plurality of identification plates integrally moulded on the crossbar. The identification units are connected to one another by means of a frame, wherein the frame is provided with a guidance device for guiding the identification mat in a printer. The identification mat allows identification units to be provided which can be labelled or printed essentially using all commercially available printing methods, particularly using a thermal transfer printing method and/or an inkjet printing method. The identification mat is produced from an amorphous plastic.

15 Claims, 3 Drawing Sheets

Figure 1:
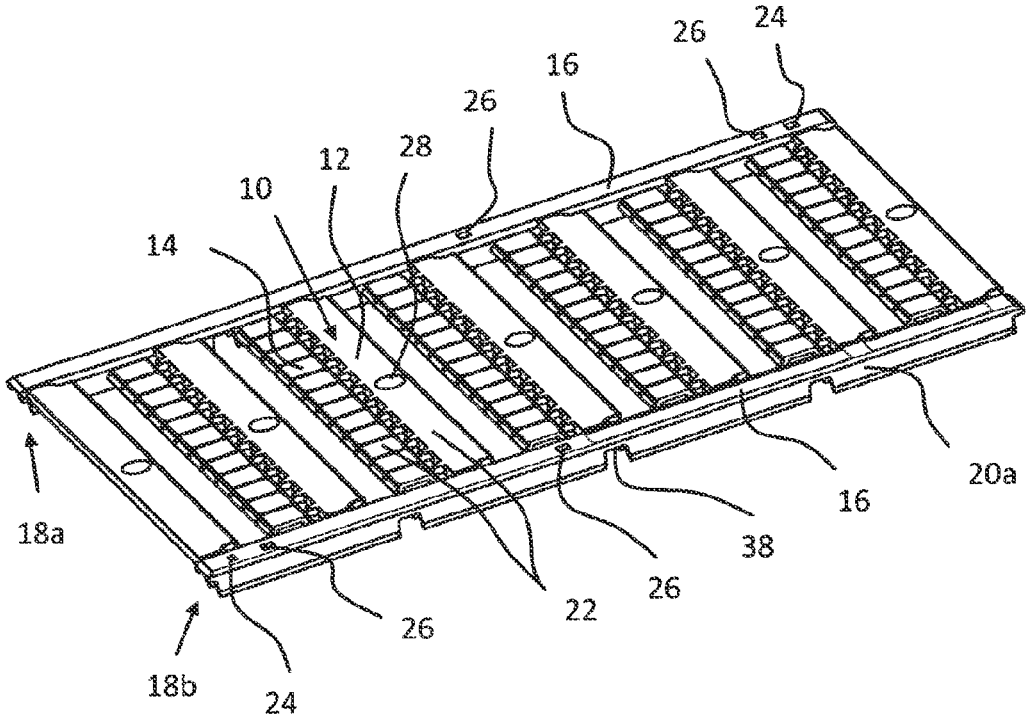

(51) Int. Cl.
*G09F 3/06* (2006.01)
*G09F 3/02* (2006.01)

(56) References Cited

U.S. PATENT DOCUMENTS 5,115,586 A * 5/1992 Hawker ..... 40/316
H1982 H * 8/2001 Dunn et al. ..... 427/258
6,277,456 B1 * 8/2001 Bulgrin et al. ..... 428/40.1
2009/0068385 A1 * 3/2009 Hill et al. ..... 428/34.9
2011/0246841 A1 10/2011 Honda et al.

FOREIGN PATENT DOCUMENTS

DE 102009008793 A1 8/2010
GB 1237401 A 6/1971
NL 8600961 A 11/1987

* cited by examiner

IDENTIFICATION MAT FOR IDENTIFYING ELECTRICAL COMPONENTS, AND METHOD FOR MANUFACTURING SUCH AN IDENTIFICATION MAT

CROSS REFERENCE TO RELATED APPLICATIONS

This application is a U.S. national phase application under 35 U.S.C. §371 of International Application No. PCT/EP2011/004124, filed on Aug. 16, 2011, and claims benefit to German Patent Application No. DE 10 2010 034 993.3, filed on Aug. 20, 2010. The international application was published in German on Feb. 23, 2012, as WO 2012/022469 A1 under PCT Article 21(2).

The invention relates to an identification mat for identifying electrical components, having a plurality of identification units, an identification unit having a transverse web and a plurality of designation plates which are formed integrally on the transverse web, the identification units being connected to one another via a frame, guide means for guiding the identification mat in a printer being provided on the frame.

Furthermore, the invention relates to a method for producing an identification mat for identifying electrical components having a plurality of identification units, an identification unit being formed from a transverse web and a plurality of designation plates which are formed integrally on the transverse web, the identification units being connected to one another via a frame, guide means for guiding the identification mat in a printer being arranged on the frame.

Identification units of this type serve to identify electrical components, such as terminals, plugs, cables, leads and the like. An identifier which characterizes the respective component is printed onto an inscription area of an identification unit. Here, the identification units are usually produced as identification mats from plastic using an injection-molding process, with the result that a multiplicity of identification units which are linked up via a frame can be inscribed jointly in an inscription unit, such as a printer.

Here, the identification units and the identification mats are usually produced from a purely partially crystalline plastic, such as polyamide. However, identification units which are produced from a partially crystalline plastic, such as polyamide, have the disadvantage that they are not suitable for all printing processes. In particular, identification units of this type can be printed or inscribed only with difficulty by means of a thermal transfer printing process and/or an inkjet printing process, since, on account of the material properties of a partially crystalline plastic, the ink can be detached or scraped off readily from the inscribed area of an identification unit which is produced in this way.

The invention is therefore based on the object of providing a solution which makes it possible to provide identification units which can be inscribed or printed substantially using all commercially available printing processes, in particular using a thermal transfer printing process and/or an inkjet printing process.

In the case of an identification mat of the type which is described in greater detail at the outset, the object is achieved by virtue of the fact that the identification mat is formed from an amorphous plastic.

In the case of a method of the type which is described in greater detail at the outset, the object is achieved by virtue of the fact that the identification mat is injection-molded from an amorphous plastic.

It has been shown surprisingly that, in contrast to partially crystalline plastics, amorphous plastics possess an improved inscription capability or printability and can be printed, in particular, by means of inkjet printers and thermal transfer printers, without there being the risk that the ink which is applied during printing is detached or can be detached afterward again from the surface of the identification units or from the inscription area of the identification units. Identification mats and identification units made from an amorphous plastic are therefore suitable for all conventional printing processes, with the result that the functionality of the identification mats and identification units according to the invention is improved substantially in comparison with conventional identification mats and identification units. In addition, identification mats which are formed from an amorphous plastic are distinguished by satisfactory dimensional stability, low volume shrinkage, and low water absorption, as a result of which the printability is improved further.

Advantageous refinements of the invention are specified in the subclaims.

According to one preferred refinement of the invention, the amorphous plastic is polycarbonate (PC), acrylonitrile butadiene styrene (ABS), polymethyl methacrylate (PMMA), polystyrene (PS), polyetherimide (PEI), polyethersulfone (PES), polysulfone (PSU), polyphenylene oxide (PPO), styrene acrylonitrile (SAN) or an amorphous/partially crystalline blend, or polycarbonate (PC), acrylonitrile butadiene styrene (ABS), polymethyl methacrylate (PMMA), polystyrene (PS), polyetherimide (PEI), polyethersulfone (PES), polysulfone (PSU), polyphenylene oxide (PPO), styrene acrylonitrile (SAN) or an amorphous/partially crystalline blend is used as amorphous plastic. Instead of a purely amorphous plastic, such as polycarbonate for example, a mixed plastic can therefore also be used, that is to say an amorphous/partially crystalline blend, such as for example a polycarbonate blend, in which at least one of the contained plastics is an amorphous plastic. An amorphous/partially crystalline blend of this type can be, for example, polybutylene terephthalate/polycarbonate (PBT/PC) or polyamide/acrylonitrile butadiene styrene (PA/ABS). Polycarbonate is particularly preferably used as amorphous plastic, since polycarbonate has particularly satisfactory dimensional stability and particularly low water absorption.

According to one preferred refinement of the invention, the guide means have at least one web for engagement into the printer, at least one side face of the web being of beveled configuration. The web of the guide means serves to be able to engage into a receptacle which is provided on the printer, in order for it to be possible to realize targeted guidance of the identification mat in the printer. The web is preferably fastened with one end to the frame. With its free end which lies opposite the end which is fastened to the frame, the web engages into the receptacle which is provided on the printer. In order, during the production of the identification mat, to realize improved and easier demolding, in particular, of the guide means or the web from the injection-molding die, the web preferably has a chamfer or bevel on at least one side face, preferably in the region of its free end, with the result that the cross-sectional area of the web decreases toward the free end.

It is preferably provided that the guide means are of substantially U-shaped configuration. In the case of a U-shaped configuration of the guide means, each guide means has two webs which are arranged substantially parallel to one another. As a result, particularly reliable guidance of the identification mat in the printer can be ensured which is, in particular, secured against tilting and rotation. At their free end, the two webs can have a chamfer or a bevel on their side faces which are directed toward one another, that is to say on the side faces which lie within the U-shape, and/or on their side faces which are directed away from one another, that is to say on the side faces which lie outside the U-shape. If a chamfer or a bevel is provided in each case on the inner side faces, directed toward one another, of two webs which run parallel to one another, the inner side face of the U-shaped configuration is of substantially trapezoidal configuration. This achieves a particularly satisfactory demolding capability of the identification mat, in particular in the region of the guide means.

Furthermore, it is preferably provided that the guide means have one or more recesses along their longitudinal extent. Here, the recesses are preferably provided on the web or the webs of a guide means. The recesses can be configured in the form of notches which can serve for transport within the printer, for separating and for fixing. Furthermore, the recesses can be configured in the form of cutouts which are formed in an elongate manner, as a result of which the demolding of the identification mat in the region of the guide means out of the injection-molding die can be facilitated and/or the distortion of the identification mat in the region of the guide means can be reduced.

In order for it to be possible to reduce the distortion further, it is provided according to one more preferred refinement of the invention that reinforcing ribs are provided on the guide means. The reinforcing ribs are preferably arranged on that side face of the guide means which is directed in the direction of the identification units. As a result, greater stability can be imparted both to the guide means, in particular in the region of their webs, and to the frame, as a result of which the guidance in the printer can also be improved. Here, the reinforcing ribs preferably extend in the longitudinal direction of the guide means and are arranged between two identification units which are arranged adjacently to one another.

In order to print the identification mat in a printer, the transverse webs and/or the designation plates have an inscription area, the inscription area preferably having a roughness Ra of ≤0.5 μm or being provided with a roughness Ra of ≤0.5 μm. The roughness in the region of the inscription areas is preferably achieved by virtue of the fact that the injection-molding die is of roughened configuration in the region of the inscription areas, for example by sandblasting, with the result that said roughened surface of the injection-molding die or of the die inserts which are arranged therein can be reproduced on the identification mat in the region of the inscription areas after the injection-molding process. The corresponding roughness of the inscription area can achieve improved adhesion of the printer's ink, in particular of the ink, on the inscription area, as a result of which the printability can be increased further. Here, however, the roughness is of such fine configuration that the inscription area is preferably of planar configuration. Here, the roughness preferably lies in a range between 0.1 and 0.5 μm, preferably between 0.2 and 0.4 μm. In order to further increase the printability, the inscription area preferably additionally has a waviness WT of ≤10 μm, preferably in a range between 1 μm and 10 μm.

In order to exert as low a pressure as possible on the guide means during the production of the identification mat according to the invention, the injection points for injection-molding the identification mat are provided on the transverse webs, with the result that the identification mat is molded onto the transverse webs and not in the region of the guide means. One or more injection points can be provided per transverse web, it also being possible that an injection point is not provided on every transverse web which is provided on an identification mat. Here, the injection points are preferably provided in the center along the longitudinal extent of the transverse webs, in order to achieve as uniform a distribution as possible of the material during the injection molding over the entire area of the identification mat. The guide means are relieved by virtue of the fact that the injection molding does not take place in the region of the guide means, since a lower pressure is applied to said guide means, as a result of which the subsequent demolding of the guide means out of the injection-molding die is facilitated.

It is provided according to one more preferred refinement of the invention that a predetermined break point is provided in a connecting region between an identification unit and the frame. The predetermined break point can be configured in the form of a reduction of the material in the connecting region or by way of a perforation in the connecting region. The predetermined break point makes simplified separation of an identification unit from the frame possible, after said identification unit has been inscribed or printed.

Furthermore, it is advantageously provided that control holes are provided on the frame. The control holes serve to make it possible for the position, in particular the positional direction, of the identification mat in the printer to be detected automatically, with the result that the print layout can be adapted to the position or the positional direction of the identification mat by way of, for example, rotation of the print layout, as a result of which the number of faulty inscriptions or faulty prints can be reduced considerably. A plurality of control holes are preferably provided at a defined spacing from one another along the longitudinal direction of the frame.

In order to achieve an unambiguous assignment of the identification mats in a printer, it is preferably provided, furthermore, that the identification mat is provided with an identifier. The identifier is preferably provided on the frame of the identification mat. The identifier can be provided, for example, in the form of a 10 bit code.

Figure 2:
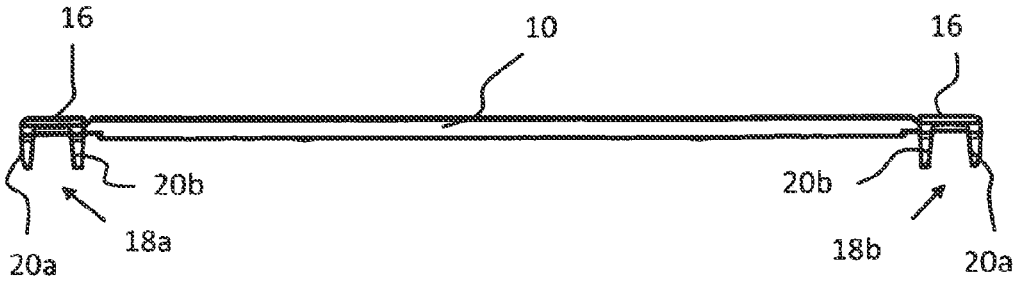
Figure 3:
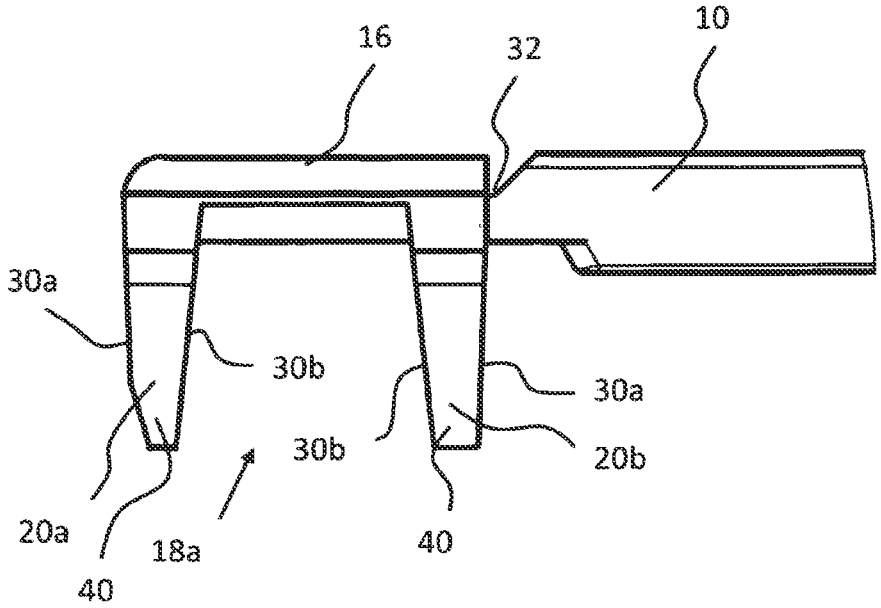
Figure 4:
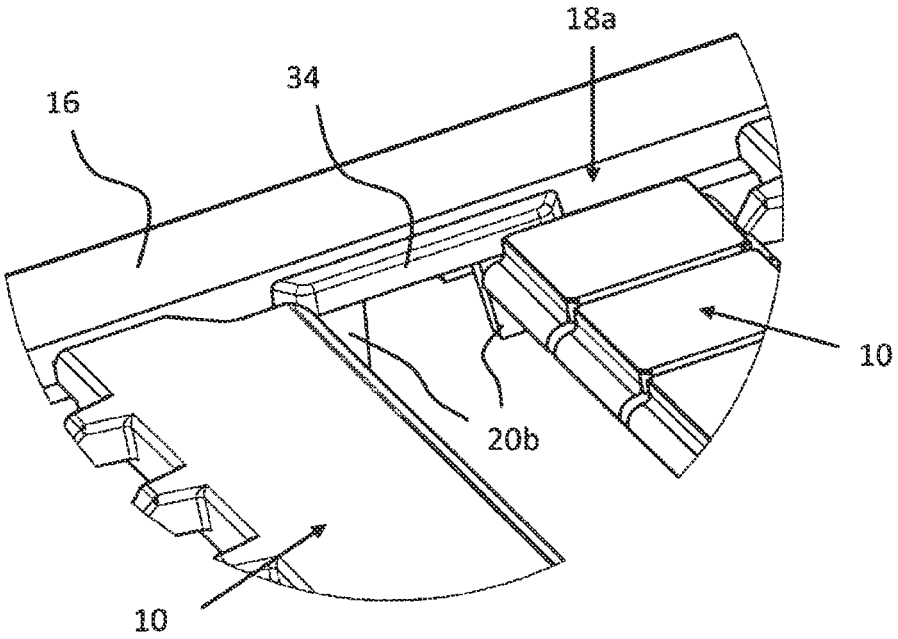
Figure 5:
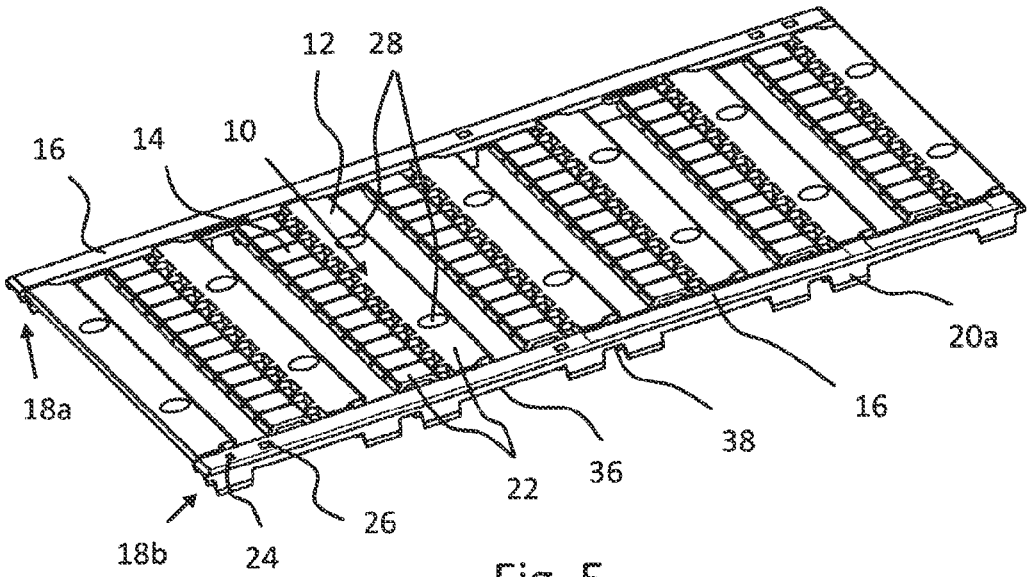
Figure 6:
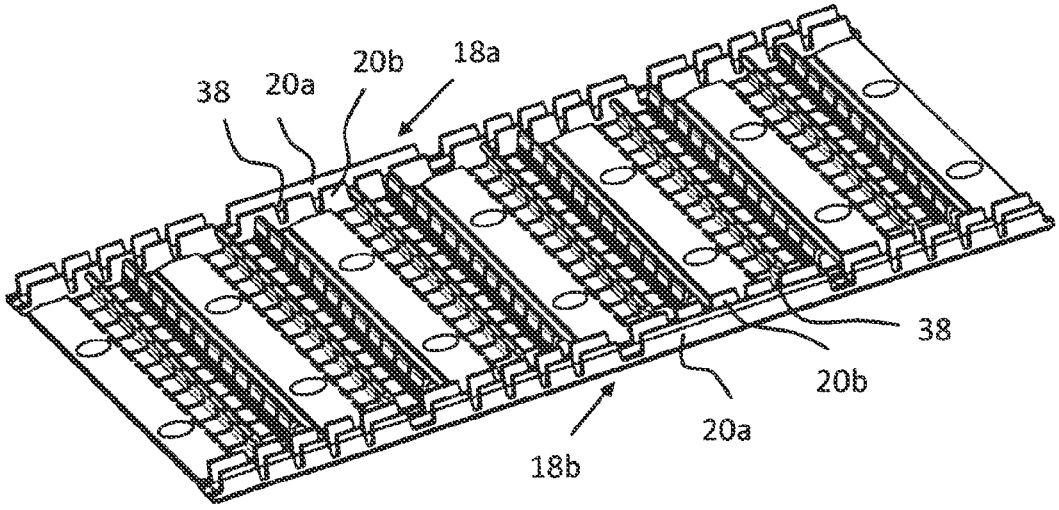

In the following text, the invention will be explained in greater detail using preferred embodiments with reference to the appended drawings, in which:

FIG. 1 shows a perspective diagrammatic illustration of an identification mat according to the invention in accordance with a first embodiment with a plan view of the upper side of the identification mat, FIG. 2 shows a diagrammatic view of the transverse side of the identification mat according to the invention shown in FIG. 1, FIG. 3 shows a detail of the identification mat shown in FIG. 2, in a plan view of the transverse side, the frame and a guide means, arranged thereon, of the identification mat being shown on an enlarged scale, FIG. 4 shows a detail of the identification mat shown in FIG. 1 with a reinforcing rib arranged on a guide means, FIG. 5 shows a perspective diagrammatic illustration of an identification mat according to the invention in accordance with a second embodiment with a plan view of the upper side of the identification mat, and FIG. 6 shows a perspective diagrammatic illustration of an identification mat according to the invention in accordance with a third embodiment with a plan view of the underside of the identification mat.

FIG. 1 shows an identification mat for identifying electrical components according to the invention. The identification mat has a plurality of identification units 10 which are arranged in a row one behind another, each identification unit having a transverse web 12 and a plurality of designation plates 14 which are formed integrally on the transverse web 12. The identification units 10 which are arranged in a row one behind another are connected to one another via a frame 16 which runs laterally along the identification units 10. Here, the frame 16 is provided to the right and left of the identification units 10 along their transverse side faces. In order to guide the identification mat in a printer, in which an inscription or a print of the identification units 10 in the region of their inscription areas 22 takes place, guide means 18*a*, 18*b* are provided on the frame 16, which guide means 18*a*, 18*b*, as can be seen in FIG. 2, are formed from in each case two webs 20*a*, 20*b* which are arranged parallel to one another, with the result that the guide means 18*a*, 18*b* are of substantially U-shaped configuration. Two guide means 18*a*, 18*b* are arranged on the frame 16, a first guide means 18*a* being arranged to the left of the transverse side of the identification units 10 on the frame 16 and a second guide means 18*b* being arranged to the right of the transverse side of the identification units 10 on the frame 16.

As is shown in FIG. 1, a plurality of recesses 38 in the form of notches are provided along the webs 20*a*, 20*b*. Furthermore, control holes 24 and identifiers 26 are made on the frame 16, it being possible for the identifier 26 to be configured in the form of a 10 bit code.

The identification mat is produced from an amorphous plastic, such as PC, ABS, PMMA, PS, PEI, PES, PSU, PPO, SAN or an amorphous/partially crystalline blend by way of an injection-molding process. The molding during the injection-molding process takes place on the transverse web 12 of the identification units 12, the injection point 28 being provided centrally along the longitudinal direction of the transverse webs 12 in the embodiment which is shown in FIG. 1.

A surface roughness Ra of ≤0.5 μm, preferably Ra=0.25 μm, is impressed on the identification mat at least in the region of the inscription areas 22 after the injection molding in the injection-molding die. The inscription areas 22 can be provided on the transverse web 12 and/or the designation plates 14 of an identification unit 10.

FIG. 3 shows an enlarged illustration, in particular, of the webs 20*a*, 20*b* of the guide means 18*a*. The webs 20*a*, 20*b* are arranged substantially parallel to one another, as a result of which the guide means 18*a* has a U-shaped configuration in the form of a runner The side faces 30*a*, 30*b* of the webs 20*a*, 20*b* are provided in each case with a chamfer, the webs 20*a*, 20*b* having a chamfer both on their inner side face 30*b* and on their outer side face 30*a* in the embodiment which is shown here. The chamfer can extend over the entire length of a side face 30*a*, 30*b* or can be provided only in regions, in particular at the free end 40 of the webs 20*a*, 20*b*. The chamfers are configured in such a way that the cross-sectional area of the webs 20*a*, 20*b* decreases toward their free end 40. The side faces 30*a*, 30*b* of beveled configuration makes easier demolding of the identification mat out of the injection-molding die in the region of the guide means 18*a*, 18*b* possible.

A predetermined break point 32 in the form of a material reduction is formed at the connecting region between the frame 16 and the identification unit 10.

In order to increase the stability of the guide means 18*a*, 18*b* and to reduce the distortion, reinforcing ribs 34 can be provided, as is shown in FIG. 4, on the guide means 18*a*, 18*b*, only the guide means 18*a* being shown here, in particular in the region of the webs 20*b* which are arranged on the guide means 18*a*, 18*b* or the frame 16 adjacently to the identification units 10, which reinforcing ribs 34 are configured in the form of a web of elongate configuration and extend in the longitudinal direction of the identification mat. The reinforcing ribs 34 are provided on the guide means 18*a*, 18*b* between two identification units 10.

FIG. 5 shows a second possible embodiment of the identification mat according to the invention, the embodiment which is shown here corresponding substantially to the identification mat which is shown in FIG. 1. The two differences between the embodiment shown here and in FIG. 1 are merely that two injection points 28 are provided per transverse web 12 in the case of the identification mat which is shown in FIG. 5. The number of injection points 28 is dependent on the size of the identification mat and the designation plates. Furthermore, in the case of the identification mat which is shown in FIG. 5, recesses 36 in the form of elongate cutouts are provided on the guide means 18*b* which is visible here or the web 20*b* of the guide means 18*b*, in addition to the recesses 38 which are configured in the form of notches, on the guide means 18*b* which is visible here.

FIG. 6 shows a third possible embodiment of the identification mat according to the invention, which embodiment corresponds substantially to the embodiment which is shown in FIG. 5, the possibility being shown in FIG. 6 that recesses 36, 38 of different configuration can be provided on two webs 20*a*, 20*b* of a guide means 18*a*, 18*b* which run substantially parallel to one another, with the result that the recesses 36, 38 on one web 20*a* do not have to be configured identically to the recesses 36, 38 on the other web 20*b* of a guide means 18*a*, 18*b*, FIG. 6 showing merely recesses in the form of notches. In the embodiment which is shown in FIG. 6, a greater number of recesses 38 which are provided in the form of notches are configured on the web 20*b* of the guide means 18*a*, 18*b* than on the web 20*a* of the guide means 18*a*, 18*b*.

LIST OF DESIGNATIONS

10 Identification unit
12 Transverse web
14 Designation plate
16 Frame
18*a*,18*b* Guide means
20*a*, 20*b* Web
22 Inscription area
24 Control hole
26 Identifier
28 Injection point
30*a*, 30*b* Side face
32 Predetermined break point
34 Reinforcing rib
36 Recess
38 Recess
40 Free end

The invention claimed is:

1. An identification mat for identifying electrical components, having a plurality of identification units, at least one of the identification units having a transverse web and a plurality of designation plates which are formed integrally on the transverse web, the identification units being connected to one another via a frame, a guide for guiding the identification mat in a printer being provided on the frame, wherein the identification mat is formed from an amorphous plastic and at least one of the transverse web or at least one of the plurality of designation plates of the identification units includes an inscription area with an inscription printed thereon by at least one of an inkjet printer or a thermal transfer printer.

2. The identification mat as claimed in claim 1, wherein the amorphous plastic comprises polycarbonate, acrylonitrile butadiene styrene, polymethyl methacrylate, polystyrene, polyetherimide, polyethersulfone, polysulfone, polyphenylene oxide, styrene acrylonitrile or an amorphous/partially crystalline blend.

3. The identification mat as claimed in claim 1, wherein the guide has at least one web for engagement into the printer, at least one side face of the at least one web for engagement into the printer being of beveled configuration.

4. The identification mat as claimed in claim 1, wherein the guide is of substantially U-shaped configuration.

5. The identification mat as claimed in claim 1, wherein the guide has one or more recesses along its longitudinal extent.

6. The identification mat as claimed in claim 1, wherein reinforcing ribs are provided on the guide.

7. The identification mat as claimed in claim 1, wherein in a region of the inscription area, the identification mat is provided with a roughness Ra of ≤0.5 μm.

8. The identification mat as claimed in claim 1, wherein one or more injection points is/are provided on the transverse web.

9. The identification mat as claimed in claim 1, wherein a predetermined break point is provided in a connecting region between an identification unit and the frame.

10. The identification mat as claimed in claim 1, wherein control holes are provided on the frame.

11. The identification mat as claimed in claim 1, wherein the identification mat is provided with an identifier.

12. A method for producing an identification mat for identifying electrical components having a plurality of identification units, the method comprising:

forming at least one identification unit from a transverse web;

integrally forming a plurality of designation plates on the transverse web;

connecting the identification units to one another via a frame;

providing the frame with a guide configured to guide the identification mat in a printer being arranged on the frame; and printing an inscription using at least one of an inkjet printer or a thermal transfer printer on an inscription area on at least one of the transverse web or at least one of the plurality of designation plates of the identification units, wherein the identification mat is injection-molded from an amorphous plastic.

13. The method as claimed in claim 12, wherein the amorphous plastic comprises polycarbonate, acrylonitrile butadiene styrene, polymethyl methacrylate, polystyrene, polyetherimide, polyethersulfone, polysulfone, polyphenylene oxide, styrene acrylonitrile or an amorphous/partially crystalline blend.

14. The method as claimed in claim 12, wherein the identification mat is injection-molded onto the transverse web of the identification units.

15. The method as claimed in claim 12, wherein in a region of the inscription area, the identification mat is provided with a roughness Ra of ≤0.5 μm.

* * * * *